US007740551B2

(12) United States Patent
Nurnberg et al.

(10) Patent No.: US 7,740,551 B2
(45) Date of Patent: Jun. 22, 2010

(54) BLADDER

(75) Inventors: Hans Peter Nurnberg, Langenzenn (DE); David John Drury, Worcestershire (GB); Timothy David Lucas, Erlangen (DE); Roland Gunter Seydel, Herzogenaurach (DE)

(73) Assignee: adidas International Marketing B.V., Amsterdam (NL)

( * ) Notice: Subject to any disclaimer, the term of this patent is extended or adjusted under 35 U.S.C. 154(b) by 109 days.

(21) Appl. No.: 11/229,483

(22) Filed: Sep. 16, 2005

(65) Prior Publication Data

US 2006/0063622 A1 Mar. 23, 2006

(30) Foreign Application Priority Data

Sep. 17, 2004 (DE) ..... 10 2004 045 176

(51) Int. Cl.
*A63B 43/06* (2006.01)

(52) U.S. Cl. ..... 473/570; 473/594

(58) Field of Classification Search ..... 473/594, 473/595, 570, 571
See application file for complete search history.

(56) References Cited

U.S. PATENT DOCUMENTS

| | | | | |
|---|---|---|---|---|
| 415,884 | A | 11/1889 | Shibe | |
| 495,863 | A * | 4/1893 | Whitzel | 473/571 |
| 996,458 | A * | 6/1911 | Coleman | 273/115 |
| 1,187,029 | A | 6/1916 | Beebout | |
| 1,614,853 | A | 11/1927 | Schwartz | |
| 1,923,236 | A | 8/1933 | Sonnett | |
| 2,020,484 | A * | 11/1935 | Turner | 473/570 |
| 2,078,881 | A | 4/1937 | Münzinger | |
| 2,221,534 | A | 11/1940 | Voit et al. | |
| 2,653,818 | A | 9/1953 | Tebbetts, Jr. et al. | |
| 2,874,964 | A | 2/1959 | Edwards | |
| 3,112,521 | A | 12/1963 | Ward | |
| 3,119,618 | A | 1/1964 | Molitor et al. | |
| 3,185,476 | A | 5/1965 | Fechner | |
| 3,229,976 | A * | 1/1966 | Allen, Jr. | 473/570 |
| 3,508,750 | A | 4/1970 | Henderson | |
| 3,580,575 | A * | 5/1971 | Speeth | 473/570 |
| 3,616,165 | A * | 10/1971 | Nishi | 442/166 |
| 4,065,150 | A | 12/1977 | Van Auken | |
| 4,154,789 | A | 5/1979 | Delacoste | |
| 4,187,134 | A | 2/1980 | Svub et al. | |
| 4,261,565 | A | 4/1981 | Massino | |
| 4,285,846 | A | 8/1981 | Hardy et al. | |
| 4,318,544 | A | 3/1982 | Brine | |

(Continued)

FOREIGN PATENT DOCUMENTS

| | | |
|---|---|---|
| CH | 403593 | 6/1966 |

(Continued)

OTHER PUBLICATIONS

DM/055893, filed Apr. 2001, WIPO.

*Primary Examiner*—Steven Wong
(74) *Attorney, Agent, or Firm*—Goodwin Procter LLP

(57) ABSTRACT

The invention relates to a bladder for an inflatable ball including structure for receiving an electronic device therein. The structure facilitates at least one of cushioning, positioning, locating, and supporting the electronic device. The structure cushions reaction forces arising from a foot strike to the bladder and/or provides a restoring force to the electronic device subsequent to a foot strike to maintain the device in its predetermined position.

23 Claims, 12 Drawing Sheets

U.S. PATENT DOCUMENTS

| | | | | |
|---|---|---|---|---|
| 4,333,648 | A | 6/1982 | Aoyama | |
| 4,399,992 | A | 8/1983 | Molitor | |
| 4,462,590 | A | 7/1984 | Mitchell | |
| 4,660,831 | A | 4/1987 | Kralik | |
| 4,798,386 | A | 1/1989 | Berard | |
| 4,802,671 | A | 2/1989 | Gentiluomo | |
| 4,826,177 | A | 5/1989 | Ponte | |
| 4,856,781 | A | 8/1989 | Shishido et al. | |
| 4,998,734 | A | 3/1991 | Meyer | |
| 5,040,795 | A | 8/1991 | Sonntag | |
| 5,091,265 | A | 2/1992 | Kennedy et al. | |
| 5,104,126 | A | 4/1992 | Gentiluomo | |
| 5,123,659 | A | 6/1992 | Williams | |
| 5,181,717 | A | 1/1993 | Donntag et al. | |
| 5,310,178 | A | 5/1994 | Walker et al. | |
| 5,320,345 | A | 6/1994 | Lai et al. | |
| D352,317 | S | 11/1994 | Bassignani | |
| 5,405,469 | A | 4/1995 | Lin | |
| 5,413,331 | A | 5/1995 | Stillinger | |
| D360,917 | S | 8/1995 | Monso | |
| 5,516,107 | A | 5/1996 | Okumoto et al. | |
| 5,649,701 | A | 7/1997 | Mills et al. | |
| 5,672,120 | A | 9/1997 | Ramirez et al. | |
| 5,688,192 | A | 11/1997 | Aoyama | |
| 5,688,198 | A | 11/1997 | Teifert et al. | |
| 5,711,725 | A | 1/1998 | Bengtson | |
| 5,725,445 | A * | 3/1998 | Kennedy et al. | 473/570 |
| 5,741,195 | A | 4/1998 | Sullivan et al. | |
| 5,752,890 | A | 5/1998 | Shishido et al. | |
| 5,755,634 | A | 5/1998 | Huang | |
| 5,759,123 | A | 6/1998 | Ou | |
| 5,766,707 | A | 6/1998 | Obermaier | |
| 5,772,545 | A | 6/1998 | Ou | |
| 5,823,889 | A | 10/1998 | Aoyama | |
| 5,865,697 | A | 2/1999 | Molitor et al. | |
| 5,888,157 | A | 3/1999 | Guenther et al. | |
| 5,931,752 | A | 8/1999 | Guenther et al. | |
| D418,565 | S | 1/2000 | Burgess | |
| 6,099,423 | A | 8/2000 | Ou | |
| 6,157,898 | A | 12/2000 | Marinelli | |
| 6,206,795 | B1 | 3/2001 | Ou | |
| 6,245,862 | B1 | 6/2001 | Rajagopalan | |
| 6,251,035 | B1 | 6/2001 | Fa | |
| 6,302,815 | B1 | 10/2001 | Shishido et al. | |
| 6,306,054 | B1 | 10/2001 | Dobrounig | |
| 6,398,616 | B1 * | 6/2002 | Motosko, III | 446/220 |
| 6,458,229 | B2 | 10/2002 | Dobrounig | |
| 6,503,162 | B1 | 1/2003 | Shishido et al. | |
| 6,537,125 | B1 * | 3/2003 | Motosko, III | 446/220 |
| D482,418 | S | 11/2003 | Estefano | |
| 6,685,585 | B2 | 2/2004 | Shishido et al. | |
| 2002/0077201 | A1 | 6/2002 | Davies | |
| 2003/0045383 | A1 | 3/2003 | Jiminez | |
| 2003/0073526 | A1 | 4/2003 | Morrison et al. | |
| 2003/0144095 | A1 | 7/2003 | Yang | |
| 2003/0224885 | A1 * | 12/2003 | Leal et al. | 473/570 |
| 2004/0012524 | A1 | 1/2004 | Couronne et al. | |
| 2005/0049092 | A1 * | 3/2005 | Lo | 473/594 |
| 2005/0101411 | A1 * | 5/2005 | Stiller et al. | 473/353 |
| 2005/0170920 | A1 | 8/2005 | Boyer et al. | |
| 2006/0135297 | A1 * | 6/2006 | Cruciani | 473/570 |
| 2007/0037641 | A1 * | 2/2007 | Wong | 473/594 |

FOREIGN PATENT DOCUMENTS

| | | | | |
|---|---|---|---|---|
| CN | 94242062.4 | | | 11/1995 |
| DE | 829 109 | | | 7/1949 |
| DE | 829109 | | * | 1/1952 |
| DE | 1 172 585 | | | 9/1960 |
| DE | 2125758 | | | 12/1972 |
| DE | 2723625 | | | 5/1982 |
| DE | 3918038 | | | 1/1991 |
| DE | 44 34 889 | | | 4/1995 |
| DE | 42 33 341 | | | 3/1997 |
| DE | 200 04 174 | | | 8/2001 |
| DE | 100 29 456 | | | 9/2001 |
| DE | 100 29 459 | | | 9/2001 |
| DE | 100 29 463 | | | 9/2001 |
| DE | 100 29 464 | | | 9/2001 |
| DE | 10361826 | A1 | * | 7/2005 |
| EP | 0 894 514 | A2 | | 2/1989 |
| EP | 0 385 872 | | | 3/1990 |
| EP | 1 080 745 | A1 | | 5/1999 |
| FR | 1488920 | | | 6/1967 |
| FR | 2215249 | | | 8/1974 |
| FR | 2 443 850 | | | 7/1980 |
| FR | 2 572 674 | | | 5/1986 |
| FR | 2 667 510 | | | 4/1992 |
| FR | 2752117 | A1 | * | 2/1998 |
| FR | 2797776 | A1 | * | 3/2001 |
| FR | 2 806 922 | | | 10/2001 |
| JP | 27-3908 | | | 5/1952 |
| JP | 38-16729 | | | 8/1963 |
| JP | 54-65638 | | | 5/1979 |
| JP | 215335/1983 | | | 12/1983 |
| JP | 1-265979 | | | 10/1989 |
| JP | 58-215335 | | | 12/1993 |
| JP | 8-252341 | | | 10/1996 |
| JP | 9-019516 | | | 1/1997 |
| JP | 10-323409 | | | 12/1998 |
| WO | WO 93/06894 | | | 4/1993 |
| WO | WO 95/09034 | | | 4/1995 |
| WO | WO 97/17109 | | | 5/1997 |
| WO | WO 97/20449 | | | 6/1997 |
| WO | WO 99/61114 | | | 12/1999 |
| WO | WO 01/66201 | | | 9/2001 |
| WO | WO 2005/044396 | | | 5/2005 |

* cited by examiner

BLADDER

CROSS-REFERENCE TO RELATED APPLICATION

This application claims priority to and the benefit of, German patent application Ser. No. 102004045176.1, filed on Sep. 17, 2004, the entire disclosure of which is hereby incorporated by reference herein.

TECHNICAL FIELD

The present invention relates to a bladder for an inflatable ball, in particular a soccer ball.

BACKGROUND OF THE INVENTION

In many sports, such as soccer, handball, or volleyball, it is desirable to provide additional information regarding various parameters of the sport to individuals watching the game. This concerns, for example, the position of the players and the ball at any time during the game, information concerning the velocity of the ball, and the speed and performance of individual players. Also, referees and other persons monitoring the game for compliance with the rules may benefit from such information and control the game more reliably. Additionally, it is also reasonable from a trainer's or an athlete's medical attendant's point of view not only to observe the events on the field, but also to obtain reliable data on the exact course of the game.

Therefore, several methods have been suggested in recent years wherein a transmitter is arranged in the ball and possibly further transmitters are arranged on the players, which emit or reflect electromagnetic waves or other signals. These signals can be captured by suitably arranged receivers and provide the desired information concerning the position and velocity of an object, for example the ball, at any arbitrary point in time during the game. Examples of such tracking systems are disclosed in German patent publication Nos. DE 42 33 341 C2, DE 100 55 289 A1, DE 100 29 464 A1, DE 100 29 456 A1, DE 100 29 463 A1, and DE 200 04 174 U1, the entire disclosures of which are hereby incorporated by reference herein.

An absolute necessity for the optimal operation of such a tracking system is a reliable and permanent arrangement of a transmitter or reflector within the ball. This is a considerable problem, in particular in the case of larger balls with an inflatable bladder, such as a soccer ball. Suspension of the transmitter should cushion all of the mechanical loads arising under deformations or accelerations of the ball to avoid damage to the electronic components. Moreover, the inserted transmitter should preferably not influence the mechanical properties and the trajectory of the ball. Further, many applications require an exact determination as to when the center of the ball has passed a certain line, for example the goal line of a soccer goal. Therefore, the transmitter should take an exactly defined position within the ball and maintain it permanently.

The approaches known from the prior art for the solution of this problem concern until now only constructions wherein the transmitter or a corresponding device is freely suspended by several elastic wires or similar devices within the bladder of the ball. Such arrangements are, for example, disclosed in the already mentioned DE 200 04 174 U1 and DE 100 29 459 A1, and in PCT application no. WO 97/20449 and French Patent No. 2 667 510, the entire disclosures of which are hereby incorporated by reference herein. Similar constructions are also disclosed in U.S. Pat. No. 6,251,035 B1 and German patent publication no. DE 829 109, the entire disclosures of which are hereby incorporated by reference herein. The last two documents concern objects that are positioned in the interior of the ball.

Presently known solutions, however, have several disadvantages: It is very difficult and requires a multitude of manual process steps to produce the bladders disclosed in the prior art and the corresponding balls; and the bladders known until now do not have the required stability to permanently protect the sensitive electronic components against damages. Moreover, to date, a reliable and permanent positioning of electronic components in the center of the ball could not be achieved.

Measures for increasing the stability of a bladder per se are disclosed in U.S. Pat. No. 4,826,177 and German Patent No. DE 39 18 038 C2, the entire disclosures of which are hereby incorporated by reference herein. These documents, however, concern only the shape stability of the ball (for example of a cubic ball or an exactly round ball with the common spherical shape, respectively) and do not provide any suggestions for improving the stability within the interior of the bladder or for a suitable suspension of a sensitive device.

There is, therefore, a need for a bladder for an inflatable ball, in particular a soccer ball, which is capable of maintaining a transmitter or other electronic device in a predetermined position and which sufficiently cushions arising loads to avoid damage to the device. There is a further need for such a bladder to be cost-efficient to manufacture and to not negatively affect the other properties of the ball.

SUMMARY OF THE INVENTION

This need is met generally by a bladder for an inflatable ball in accordance with any one of the following aspects of the invention.

According to one aspect, the invention relates to a bladder for an inflatable ball including at least two planar reinforcing surfaces extending inside the bladder and at least one electronic device arranged within the bladder. The electronic device is maintained in a predetermined position by the planar reinforcing surfaces. The planar reinforcing surfaces facilitate at least one of following functions: cushioning, positioning, locating, and supporting the electronic device. For example, in one embodiment, the planar reinforcing surfaces cushion reaction forces arising from a foot strike to the bladder or a ball including a bladder in accordance with the invention. In another example, the planar reinforcing surfaces provide a restoring force to the electronic device subsequent to a foot strike to maintain the device in the predetermined position.

In contrast to the prior art discussed above, the electronic device is positioned by elements that can transmit more than only pulling forces. When the electronic device is deflected from its predetermined position, the planar reinforcing surfaces provide additional shearing forces. Furthermore, they dampen, similar to an oil pressure bumper, an arising oscillation of the device, since any movement of the reinforcing surfaces causes a shift of the air volumes inside the bladder. Therefore, if, for example, a soccer ball with a bladder according to the invention is initially significantly deformed by a sharp shot of a player, which causes a substantial deflection of the device from its original position, the planar reinforcing surfaces assure that the bladder quickly regains not only its outer shape, but also the original configuration of its interior.

A further advantage is the more effective cushioning of accelerating forces acting on the electronic device by the aforementioned air volumes, which are defined by the planar reinforcing surfaces in the interior of the bladder. This reduces the mechanical load on the electronic device and, thereby, increases the device's lifetime.

In various embodiments, the electronic device is arranged substantially in a center of the bladder. A plurality of electronic devices can be arranged within the bladder. The bladder can include an electrical connection in communication with the electronic device for exchanging data and/or charging the device. In one embodiment, the electronic device is arranged at a line of intersection between the at least two reinforcing surfaces. Such an arrangement assures that several reinforcing surfaces provide a restoring force when the electronic device is deflected from the center of the bladder. The line of intersection between the at least two reinforcing surfaces can extend outwardly from a center of the bladder in a substantially radial direction. In one embodiment, the at least two reinforcing surfaces intersect with an angle other than about 90 degrees.

Additionally, a bladder in accordance with the invention can include at least two lines of intersection, wherein the lines of intersection define an angle of about 120 degrees. In one embodiment, the points at which the lines of intersection contact an outer surface of the bladder define a substantially regular tetrahedron. This arrangement combines a high degree of stability with a low weight due to the limited number of inner reinforcing surfaces. Further, the lines along which the reinforcing surfaces contact an outer surface of the bladder can correspond substantially to a shape of at least one panel of an outer shell of the inflatable ball.

In additional embodiments, at least one reinforcing surface defines at least one opening to allow an equalization of pressure within the bladder. The at least one opening can be located substantially in a center of the reinforcing surface. The reinforcing surfaces can include at least one auxiliary surface that does not contact an outer surface of the bladder. In one embodiment, the bladder includes a plurality of auxiliary surfaces, where the auxiliary surfaces define an inner volume for receiving the at least one electronic device. This inner volume provides additional cushioning protection for the electronic device and limits the device's deflection from its predetermined position. At least one of the bladder, the reinforcing surfaces, and the auxiliary surface can be manufactured from a thermoplastic urethane.

In another aspect, the invention relates to a bladder for an inflatable ball including at least one electronic device arranged within the bladder and a plurality of pulling elements. The pulling elements are coupled to and disposed at least partially within the bladder and coupled to the at least one electronic device to maintain the device in a predetermined position within the bladder.

In various embodiments, the pulling elements can be substantially inelastic and may include multiple pairs of pulling elements defining substantially identical angles. Each of the pulling elements may be subjected to a tensile force between the electronic device and the bladder and arranged such that a summation of the tensile forces on the electronic device equals substantially 0. Such an arrangement maintains the electronic device in static equilibrium in any orientation of the bladder, for example, while the bladder is rotating. The plurality of pulling elements provides a restoring force to the electronic device subsequent to a foot strike to maintain the device in the predetermined position. The restoring force aids post impact recovery of the electronic device by, for example, returning the electronic device quickly to its predetermined position.

In additional embodiments, the device can be arranged inside a separate chamber within the bladder. The chamber provides additional protection for the sensitive components of the electronic device. This applies not only to the use, but also to the assembly, when the device is at first inserted into the bladder and not yet protected by its cushioning suspension against impacts or other mechanical loads. The chamber can be defined by a plurality of auxiliary surfaces extending between the pulling elements, thereby creating an additional separate air cushion around the electronic device for providing improved cushioning.

In one embodiment, the chamber includes a rounded, substantially spherical shape; however, other shapes are contemplated and within the scope of the invention. A rounded, spherical shape provides maximum protection against arising mechanical loads. If under an extreme deformation of the bladder, for example during a penalty shot of a soccer ball, the outer surface is deformed to more than the predetermined position of the device, the rounded shape of the chamber assures that the arising impact deflects the chamber to the side and does not cause a maximum acceleration of the component, which could destroy the sensitive electronics. Moreover, a spherical shape ensures a weight distribution within the bladder having maximum symmetry, so that the mechanical properties and the flight path of the ball are influenced as little as possible. Further, the rounded shape of the chamber avoids damage to the bladder in the case of contact between the inner surface of the bladder wall and the chamber during an extreme deformation of the ball. Additionally, the chamber can be airtight with respect to an interior of the bladder or can be in fluid communication with an interior of the bladder to allow an equalization of pressure inside and outside the chamber.

Furthermore, the plurality of pulling elements can be arranged tetrahedrically within the bladder and may exhibit non-linear elongation. In one embodiment, the bladder includes a plurality of transverse elements interconnecting at least two of the pulling elements. At least one of the pulling elements can be coupled to the bladder via a plurality of sub-elements branching off from the at least one pulling element. The device can be arranged substantially in a center of the bladder and at least one of the pulling elements can extend substantially radially outwardly from the device. In one embodiment, at least one of the pulling elements includes at least one mounting section at one end thereof to anchor the pulling element to an outer surface of at least one of the bladder, the device, and the chamber. The at least one pulling element can include a bundle of fibers and the mounting section can include a plastic material injected around the bundle of fibers. Such a mounting section can be comparatively easily produced and facilitates the final assembly of the chamber and/or device within the bladder.

In one embodiment, the bundle of fibers has an impulse tensile strength of greater than 500 N, preferably greater than 1000 N, and more preferably greater than 1200 N. However, values of less than 500 N are generally also possible. Similar to the spokes of a wheel, a higher tensile strength allows a higher pre-tension of the pulling elements, which in turn leads to a more stable positioning of the device within the bladder. The pulling elements can be sufficiently heat resistant to withstand temperatures arising during bladder molding. This allows inserting the pulling elements and, if necessary, the device into the interior of the bladder prior to the final molding step for its manufacture.

In another aspect, the invention relates to a bladder for an inflatable ball including a plurality of hollow struts extending radially inwardly from an outside surface of the bladder when inflated. The struts at least partially define a cavity arranged substantially in a center of the bladder, and at least one electronic device is arranged inside the cavity. Such an arrangement allows not only inserting the device into the bladder, but also its later removal, if it is found that the device has failed. At least one of the hollow struts is adapted to pass the at least one electronic device from outside the bladder into the cavity.

In various embodiments, the bladder is manufactured from a latex material reinforced by fibers. The hollow strut adapted to pass the electronic device has a different size than other hollow struts of the bladder. The hollow strut adapted to pass the electronic device can be arranged symmetrically with a receptacle for receiving a valve of the bladder. As a result, a more even distribution of the weight in the bladder is obtained, and the struts of the bladder affect the trajectory of the corresponding ball as little as possible.

In various embodiments according to the foregoing aspects of the invention, the bladder can be produced by forming a thermoplastic material around at least one forming element that can be removed subsequently from the finished bladder. The removal of the at least one forming element from the finished bladder can include applying heat to melt the at least one forming element and removing a resultant liquid material from the finished bladder, or dissolving the at least one forming element in a solvent, for example water or oil, and removing a resultant dissolved material from the finished bladder.

The forming elements, or cores, can be arranged with a distance therebetween when molding the bladder material. As a result, comparatively complex bladder shapes can be achieved, which are exactly designed for a predetermined shape and size of the electronic device. For example, this arrangement may be used when the bladder material is applied by injection. Alternatively, the arrangement of the interspaced molding segments may also be immersed into a liquid bladder material, for example latex, for creating the bladder.

In another aspect, the invention relates to a ball including a bladder in accordance with any one of the foregoing aspects of the invention. The ball can include a carcass arranged between the bladder and an outer shell of the ball. Additionally, the ball can include a mounting cable integrated into at least one of the at least two reinforcing surfaces and interconnected to at least one of the electronic device and the carcass. Thus, the ball's carcass is included in the attachment of the electronic component and, therefore, stabilizes the device's exact and permanent positioning within the ball. The mounting cable can be arranged between two partial surfaces of a reinforcing surface. Such a "sandwich" arrangement is particularly easy to produce.

In an embodiment of the ball including a pulling element, the pulling element can be mounted to the bladder via a mounting foot and the bladder can be mounted to a mounting surface of the carcass within the range of the mounting foot. This embodiment also provides for an interconnection between the bladder and the carcass, namely in the very region where the bladder is subjected to the highest tensile loads from the electronic component when the ball is accelerated or deformed. In an embodiment of the ball including a hollow strut, an additional mounting cable can be arranged within at least one hollow strut interconnected to at least one of the electronic device and the carcass.

In another aspect, the invention relates to a method of forming a bladder. The method includes the steps of providing at least one forming element, applying a material to at least a portion of an external surface of the forming element, and removing the forming element by at least one of dissolving the forming element and melting the forming element. The step of providing at least one forming element can include assembling a plurality of forming elements to form a predetermined shape. In one embodiment, the predetermined shape is substantially spherical; however, other shapes are contemplated and within the scope of the invention. The method can further include the step of suspending an electronic device between the assembled forming elements. The step of applying a material can include, for example, at least one of injection molding and immersion.

These and other objects, along with advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Figure 1:
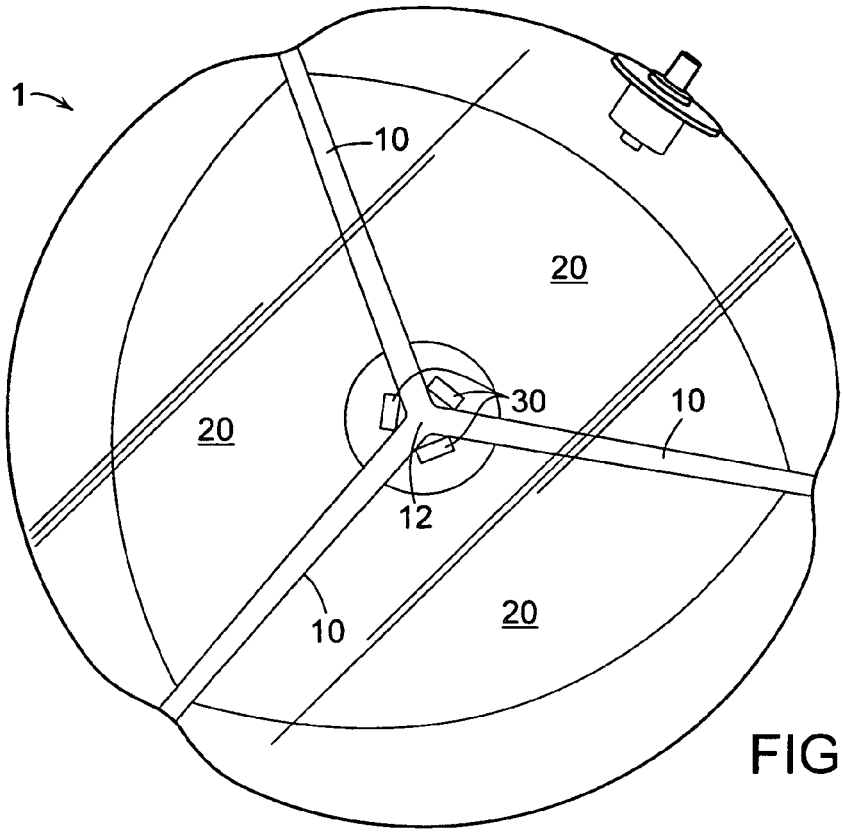
FIG. 1 is a schematic plan view of a bladder in accordance with one embodiment of the invention.

In the following, various embodiments of the present invention are described with reference to a bladder for a soccer ball, wherein a transmitter is positioned inside the bladder for use in a tracking system. It is, however, to be understood that the present invention can also be used for other balls using an inflatable bladder, such as handballs, volleyballs, rugby balls, or basketballs. Further, a different device can be arranged in the interior of the bladder instead of the transmitter, for example, a simple pressure sensor or a device for providing acoustic signals, or any other device which uses electric current for measurement purposes or for providing a signal. Also, a passive reflector for electromagnetic waves and a global positioning system are considered to be electronic devices in the meaning of the present invention.

If the transmitter or other device is an active electronic component requiring a power supply, an accumulator, for example, may be used to supply power to the device. Various constructions are conceivable for charging this accumulator, which may be used in the subsequently described embodiments of the bladder.

One possibility is to arrange an induction coil in or close to the outer surface of the ball, e.g., around the valve opening. If this induction coil is subjected to an external electromagnetic alternating field, the accumulator of the transmitter may be charged without contact. The induction coil may, however, also be arranged within the interior of the ball. In this case, the ball may be deflated so that the induction coil, arranged, for example, in the ball's center, may be brought sufficiently close to the alternating-field generating unit.

It is, however, also conceivable to arrange contacts, for example suitable metallizations, on the flexible outer surface of the ball, or in or on the valve, so that an electric contact to the device may be generated by means of a corresponding plug. In this case, at least one data line can also be provided for transmitting or reading information stored in the device, such as the charge state or other data. Additionally, information can be sent to the device to, for example, upload data or modify the settings of the device.

Besides the use of an accumulator to be charged from the outside, it is also possible to provide a power supply for the transmitter that generates the energy from the ball's acceleration movements. Such systems, known, for example, for supplying power to wrist watches, have the advantage that the ball is permanently ready for use and that charging is not required.

Typically, a ball, e.g., a soccer ball, includes a bladder being arranged within an outer shell. In the case of a soccer ball, the outer shell commonly includes a plurality of panels (e.g., pentagons or hexagons), which are adhered, sewn, or welded together. For improving the form stability, it is possible to optionally arrange a carcass between the bladder and the outer shell. In simple cases, the carcass consists of a band or the like being wound around the bladder, and may also be adhered to the bladder. Another exemplary construction of a soccer ball is disclosed in commonly owned U.S. Pat. No. 6,306,054, the entire disclosure of which is hereby incorporated by reference herein.

FIG. 1 presents an overall view of the bladder 1 according to a first aspect of the present invention. The bladder 1, as well as the further bladder embodiments discussed below, is arranged within an outer shell of a ball and a carcass, if applicable, and includes the necessary structure to locate, support, cushion, and restore position of an electronic device deposed within the bladder 1. It is, however, also contemplated and within the scope of the present invention to provide the surface of the bladder 1 with a suitable coating, such that the bladder 1 itself can be used as a ball without needing a separate outer shell.

As shown in FIG. 1, planar reinforcing panels or surfaces 10 are arranged within the bladder 1 and divide the spherical volume of the bladder 1 into several chambers 20. An electronic device 30, which is only schematically shown, is arranged at the intersection of the surfaces 10 and is, thereby, positioned substantially in the center of the bladder 1. It is, however, also possible to arrange several electronic devices, for example several redundant transmitters symmetrically distributed on the planar reinforcing surfaces 10 around the center of the bladder 1, in order to increase the reliability against a failure. Alternatively, it is also possible to arrange heavy components of the transmitter in the bladder's center and to symmetrically distribute lighter components elsewhere in the bladder 1. For example, antennas or similar functional elements may be distributed among the planar reinforcing surfaces 10, pulling elements 60 (FIG. 6), mounting cables 310 (FIG. 5), or the like. It is also possible to distribute one or more antennas on the outer surface of the bladder 1.

Concerning the selection and the arrangement of the planar reinforcing surfaces 10 within the bladder 1, a compromise must be made between using the lowest weight material and providing sufficiently stable support to the electronic device 30. In this context, it has been found that reinforcing surfaces 10 intersecting rectangularly are less desirable. By contrast, the arrangement shown in FIGS. 1 to 3, where six planar reinforcing surfaces 10 pair-wise intersect with an angle of approximately 120 degrees, is particularly desirable. As a consequence, the points 12 at which the lines of intersection 11 contact the surface of the bladder 1 define generally the corners of a regular tetrahedron.

Figure 4:
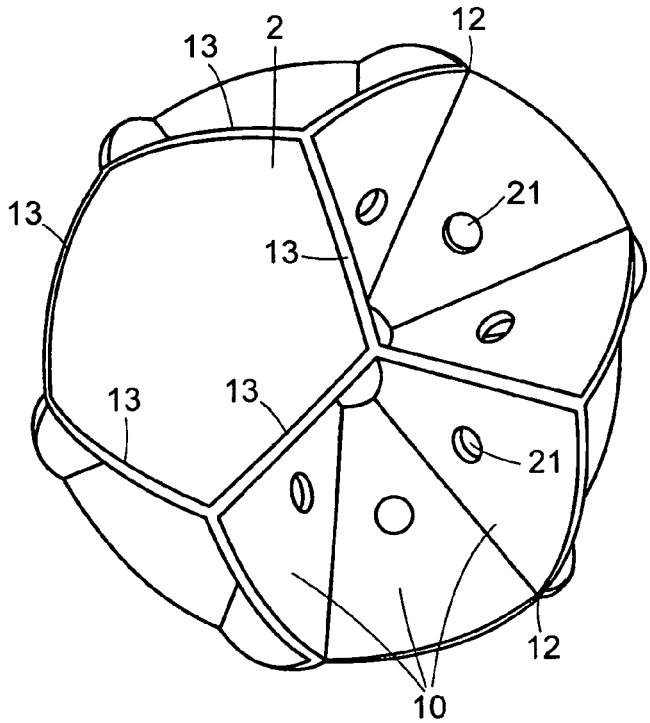
FIG. 4 is a schematic perspective view of reinforcing surfaces of a bladder in accordance with another alternative embodiment of the invention.

FIG. 4 shows an alternative embodiment with a greater number of planar reinforcing surfaces 10. It can be seen that the lines 13, along which the reinforcing surfaces 10, contact an outer surface 2 of the bladder 1, only a portion of which is shown, correspond substantially to the shape of at least one panel of the outer shell of the ball to be inflated, for example the shape of a pentagonal panel.

In the embodiments shown in FIGS. 1 to 4, several mechanisms are used to assure that in the case of a deflection from the center of the bladder 1, the electronic device 30 returns in a very short time to this position. At first, any deflection of the device 30, which in one embodiment is arranged at the intersection of the reinforcing surfaces 10, causes a strain within the reinforcing surfaces 10 and, therefore, leads to an active restoring force. Furthermore, a deflection of the device 30 from the center of the bladder 1 changes the volume of the chambers 20 defined by the reinforcing surfaces 10 and/or the outer surface 2 of the bladder 1. This leads to a pressure difference in adjacent chambers 20, which further contributes to bringing the electronic device 30 quickly back to its original position.

To avoid repeated oscillations of the device 30 around its original position, it can be desirable to provide openings 21 between the various chambers 20. This allows for an equalization of pressure and the oscillation of the device 30 around its original position is dampened by the flow of air from one chamber 20 into another. This is similar to the function of an oil-pressure bumper in a motor vehicle, wherein oil flows through a small opening from one chamber of the bumper into another to dampen any oscillating movements.

In the case of the present bladder 1, this effect can be influenced by the size of the openings 21 between the chambers 20. Various positions for the openings 21 include, for example, the intersection points 12 of the lines 13 at the outer side of the bladder 1 and/or approximately in the center of a reinforcing surface 10, as schematically shown in FIG. 4. In addition, the damping effect can be influenced by the viscosity of the gas used to inflate the bladder 1.

Figure 2:
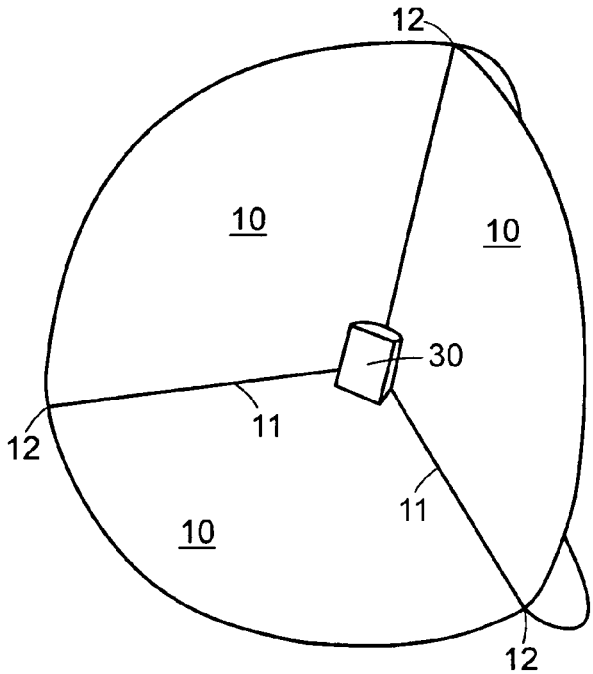
FIG. 2 is a schematic perspective view of reinforcing surfaces of a bladder in accordance with one embodiment of the invention.
Figure 3:
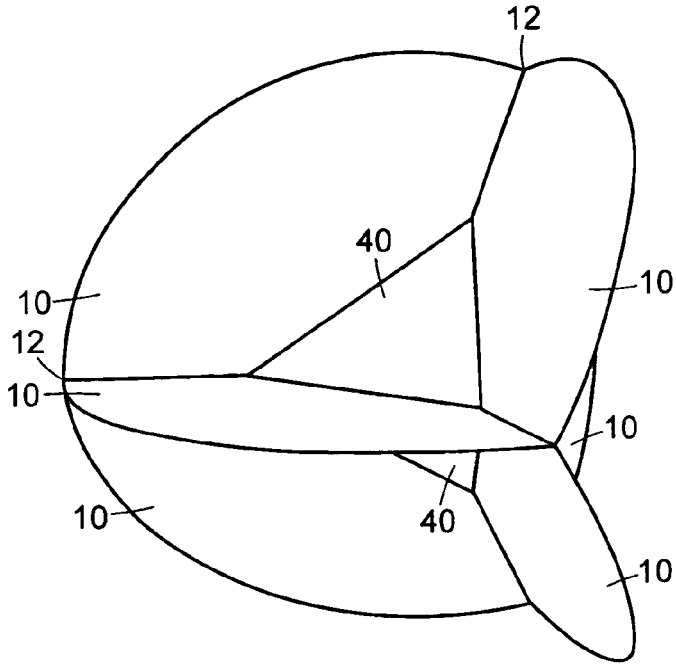
FIG. 3 is schematic perspective view of reinforcing surfaces of a bladder in accordance with an alternative embodiment of the invention.

A comparison of FIGS. 2 and 3 discloses a further aspect of a bladder 1 in accordance with the invention. In the embodiment shown in FIG. 2, the electronic device 30 is arranged directly at the intersection of six reinforcing surfaces 10. The embodiment of FIG. 3, by contrast, includes four additional auxiliary surfaces 40, two of which are shown in FIG. 3. The auxiliary surfaces 40 define a separate volume around the intersection of the six reinforcing surfaces 10 where the electronic device 30 is arranged. This arrangement provides additional protection to the electronic device 30 against damage.

It is, for example, possible to fill the volume defined by the auxiliary surfaces 40 with a foam or other cushioning material to avoid damage to the device 30, if the instep of a player penetrates deeply into the interior of the ball and the bladder 1 in the case of a very sharp shot. Alternatively, the inner volume may be filled by a gas having a particularly high pressure, thereby avoiding deformation. In addition to this protective function, the auxiliary surfaces 40 further contribute to the stabilization of the interior frame work of the bladder 1, which is created by the reinforcing surfaces 10.

The reinforcing surfaces 10, the auxiliary surfaces 40, and the outer surface 2 of the bladder 1 are preferably made from a light-weight, but tear resistant material, which can be brought into the desired shape by thermal molding. In one embodiment, a thin film made from a thermoplastic urethane (TPU) is used. The thickness of the TPU used, its material properties, and suitable treatment steps in production, if applicable, such as a pre-expansion of the film, may change the dynamic properties of the bladder 1 over wide ranges. It is also conceivable to reinforce the TPU film with glass fibers. Such reinforced TPU films are offered by, for example, the company Elastogran GmbH, of Lemforde, Germany.

Figure 16A:
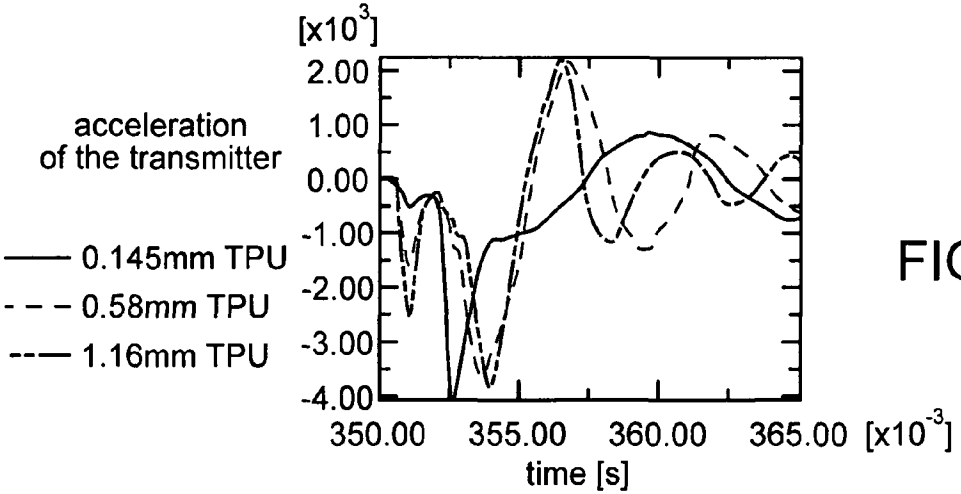
FIGS. 16*a* and 16*b* are graphical representations of the results of a finite element analysis examining the acceleration and deflection of the transmitter for thermoplastic urethane films of various thicknesses.
Figure 16B:
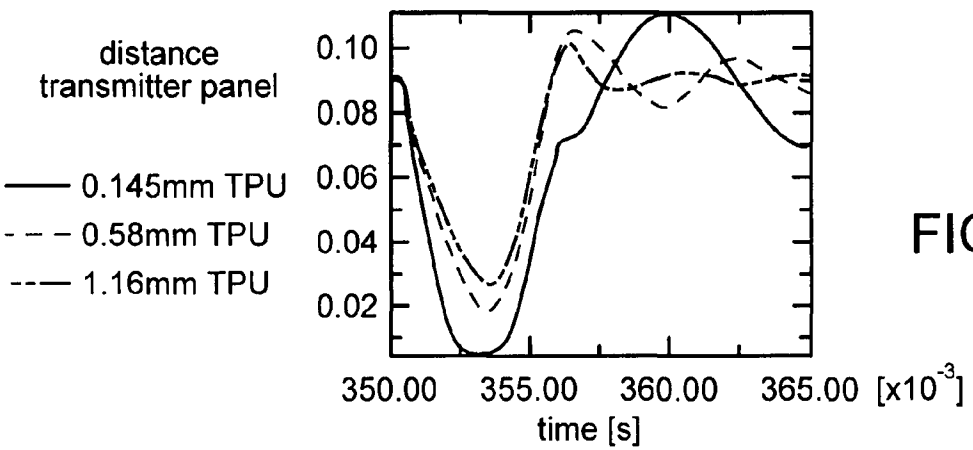

FIGS. 16*a* and 16*b* illustrate the influence of different material thicknesses on the bladder's dynamic behavior. The diagrams show the dynamic behavior of a bladder with tetrahedral reinforcing surfaces (as shown in FIG. 2) in the case of an impact at 80 mph (miles per hour). While FIG. 16*a* shows the resulting accelerations on the transmitter in the bladder's interior (in multiples of acceleration of gravity g), FIG. 16*b* shows the deflection of the transmitter. Therein, it was assumed that the transmitter has a total volume of 80 g. One can see immediately that the thickness of the TPU film used has a large influence on the response behavior of the bladder 1. It results from the diagrams that a wall thickness within a range of approximately 1 mm leads to the least deflections at comparatively low acceleration values. A wall thickness of approximately 0.5 mm still supplies good results, whereas a wall thickness of approximately 0.15 mm results in sustained contact with the bladder's outer shell.

Figure 17:
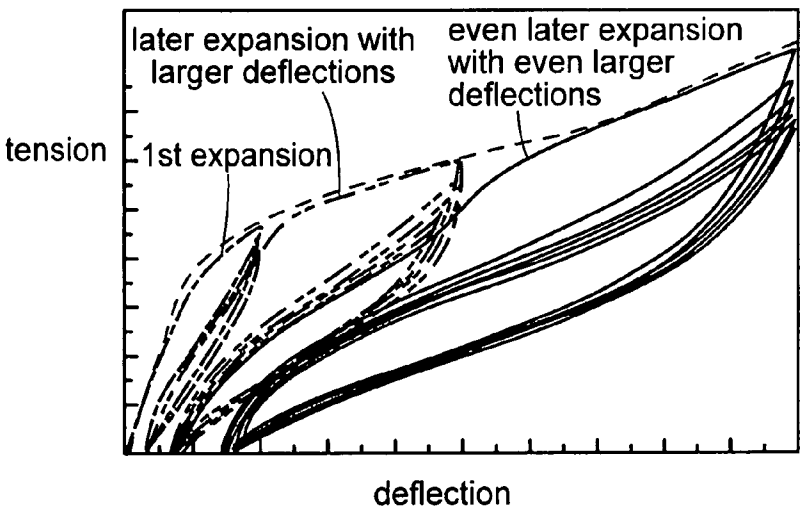
FIG. 17 is a graphical representation of hysteresis curves for the expansion of a thermoplastic urethane film.

The influence of a pre-treatment of the material, in particular an expansion of the TPU film prior to its use in the bladder 1, is shown in FIG. 17. One can see that the film does not follow a single hysteresis curve for a deflection, expansion. The shape of the respective hysteresis curve of a deflection cycle instead depends on the largest previous deflection (as shown in FIG. 17, dashed lines for the first expansion, phantom lines for the second expansion, and solid lines for the third expansion). Then, the increase of the new hysteresis curve substantially coincides with the return path of the hysteresis curve of this previous deflection. Therefore, if a certain expansion behavior of the TPU film in the bladder is to be achieved, it is advantageous to expand the film prior to assembly up to that value where the resulting hysteresis curve, and thus the TPU film's expansion behavior, shows the desired shape. As a result, the TPU film used in the bladder avoids sagging after a strong deformation or a large acceleration of the ball.

Figure 5:
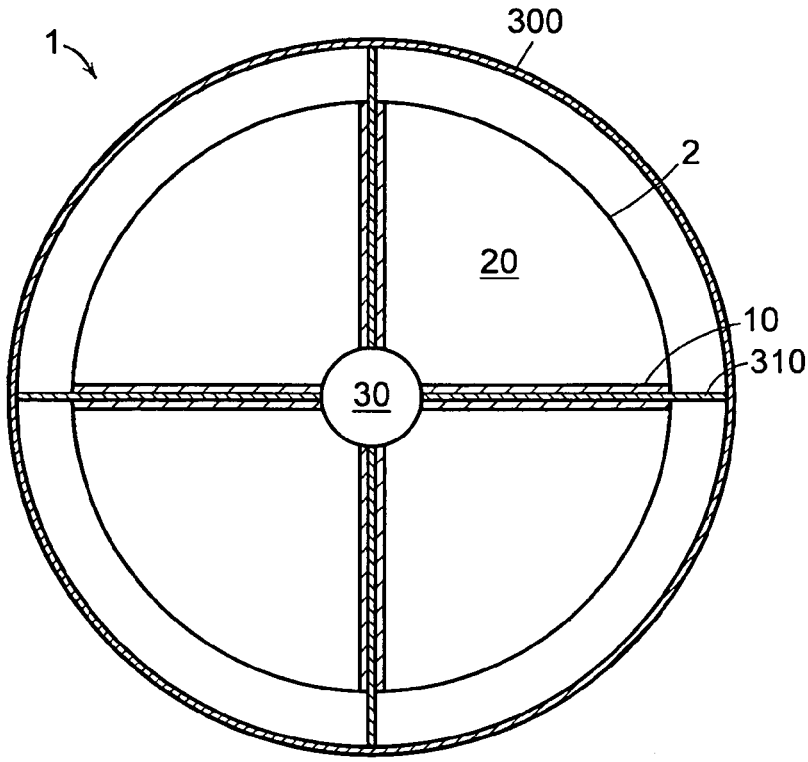
FIG. 5 is a schematic plan view of a bladder in accordance with an alternative embodiment of the invention, with reinforcing surfaces within the bladder and integrated mounting cables.
Figure 14:
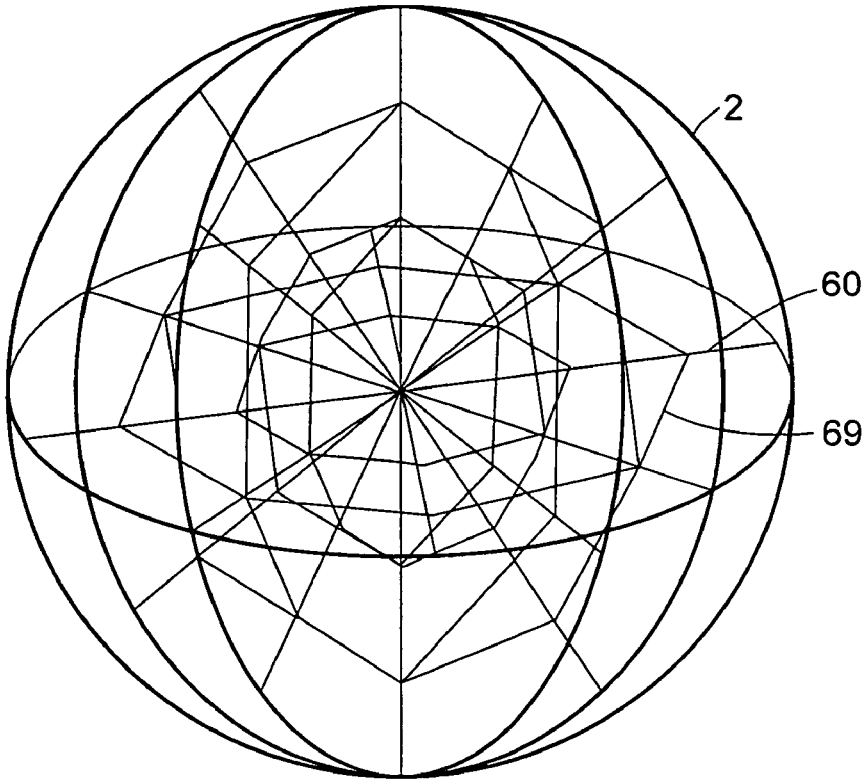
FIG. 14 is a schematic perspective view of a bladder in accordance with an alternative embodiment of the invention, with additional transverse links between the pulling elements.

A modified embodiment of the bladder 1 of FIGS. 14 is shown in FIG. 5. One or more mounting cables 310 or the like are integrated into the reinforcement surfaces 10, which are capable of receiving significant tensile strengths and are directly or indirectly coupled at their one end to the electronic component 30 and at their other end to the bladder 1 or a carcass 300 of the ball surrounding the bladder 1. Including the carcass 300 in the suspension of the electronic component further increases the stability of the anchorage of the electronic component 30 in the ball's interior. It is, however, also possible to only connect the cables 310 to the outer surface 2 of the bladder 1.

In the embodiment shown in FIG. 5, the mounting cable 310 is positioned between two partial surfaces of the reinforcing surface 10. It is possible to enable a relative movement between the partial surfaces and the mounting cable 310, as well as to stationarily anchor the mounting cable 310, e.g., by adhering, heat-sealing, etc. In a simpler embodiment of the concept of FIG. 5, only one partial surface is provided and the cable 310 is anchored thereto, for example by suitable loops or passage through corresponding holes. Adherence with the reinforcement surface 10 is also possible in this case. Besides their pure mounting function, electric lines may also be integrated in one or more cables, be it for charging the aforementioned accumulator of the transmitter 30 or be it for exchanging data with, for example, an external computer. Since the cable 310 penetrates the bladder 1 to the outside, no additional passages are required if the transmitter 30 is to be supplied with power or if communication with the transmitter 30 is desired.

Figure 6:
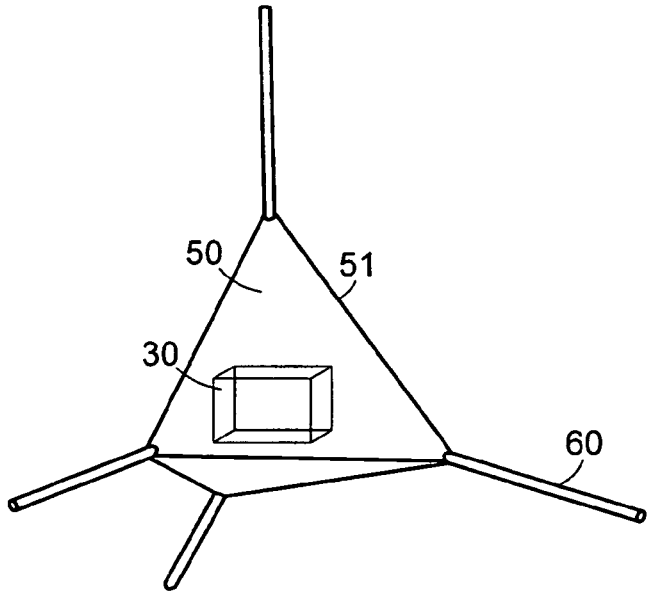
FIG. 6 is a schematic perspective view of pulling elements and a chamber within a bladder in accordance with one embodiment of the invention.
Figure 7:
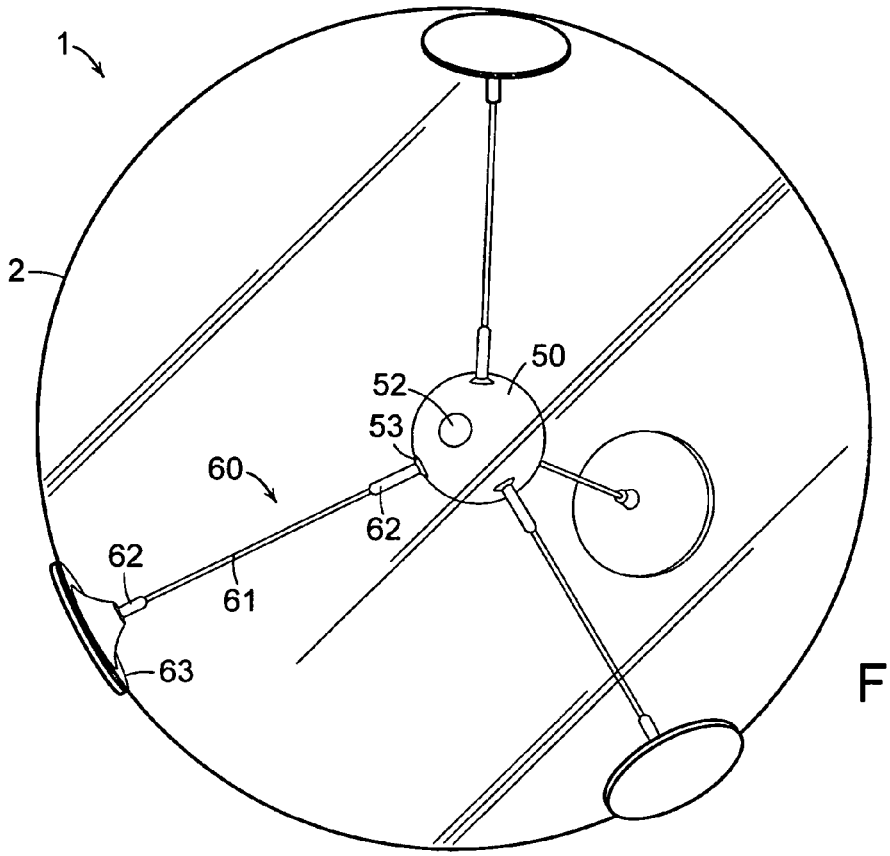
FIG. 7 is a schematic perspective view of pulling elements and a chamber for the electronic device within a bladder in accordance with one embodiment of the invention.

FIGS. 6 and 7 relate to another embodiment of the present invention, where the electronic device is arranged within a chamber 50 in the center of the bladder 1. As already explained with respect to FIG. 3, the chamber 50 provides additional protection for the electronic device 30. If, however, the chamber is made from a sufficiently stiff material, for example a light-weight but rigid plastic material, it provides protection for the sensitive components of the electronic device present during assembly of the bladder. Suitable plastic materials include, for example, thermoplastic urethane (TPU) and acrylnitrile-butadiene-styrole (ABS), which can, for example, be obtained under the trademark TERLURAN® sold by BASF.

FIG. 6 shows a simplified embodiment, where the chamber 50 is formed by interconnecting surfaces 51 between several pulling elements 60, which define the position of the chamber 50 and, thereby, the device 30 substantially in the center of the bladder 1. In one embodiment, the interconnecting surfaces 51 are sized so that more than a third of the radially arranged pulling elements 60 is within the chamber 50 or replaced by the chamber 50. As a result, the overall framework for the suspension of the electronic device 30 is reinforced significantly in its center. Smaller embodiments of the interconnecting surfaces 51, leading to a smaller chamber 50, are, however, also contemplated and within the scope of the present invention.

An alternative embodiment is shown in FIG. 7. A substantially spherical chamber 50 is arranged in the center of the bladder 1 and houses the electronic device. The chamber 50 can be sealed with respect to the interior of the bladder 1. This is desirable if the chamber 50 is arranged in the interior of the bladder 1 prior to the final manufacturing step of the bladder 1. The influence of aggressive gases or high temperatures on the sensitive components of the electronic device is, thereby, at least reduced. It is, however, also possible to provide the chamber 50 with openings 52 (FIG. 7) to reduce the mechanical load on the chamber 50 by the high air pressure inside the bladder 1.

The spherical shape of the chamber 50 provides further protection to the electronic device 30. Impacts that reach the center of the bladder 1 do not hit a planar side surface, but cause in most cases only a lateral deflection of the spherical chamber 50. This reduces the acceleration forces effectively acting on the electronic device 30.

The radial pulling elements 60 for suspending the chamber 50 in the center of the bladder 1 are, in one embodiment, made from a bundle of highly stable fibers 61, for example aramide fibers. Contrary to the prior art, e.g., DE 200 04 174 U, the pulling elements 60 are substantially inelastic or at least not highly elastic. Such fibers can be made from, for example, a copolymer of polyparaphenylen-terephtalamide (PPTA), which can, for example, be obtained under the trademark TECHNORA® sold by Teijin Limited. In one embodiment, approximately 200 single plies are arranged in parallel to form a bundle and several such bundles (for example 20 to 40) are twisted to form a complete pulling element 60. The particular advantage of these fibers is, apart from their great tensile strength, the high temperature resistance that allows processing the bladder 1 at temperatures of up to 250 degrees C. A further important aspect is the extremely small elongation of these fibers, even in case of high tensile strengths. The pulling elements are elongated by at most 30% of their initial length, preferably less than 25%, and particularly preferably less than 20%. Single plies, which make up the bundles and finally the pulling elements 60, can preferably be elongated by less than 20%, particularly preferably by less than 15% of their initial length.

The tensile strength of the pulling elements 60 is, in one embodiment, more than 1200 N. This allows suspending the chamber 50 in the interior of the bladder 1 with a high tension so that in the case of a deflection, the return to the original position is significantly accelerated, which improves the precision with which the ball's position is determined.

Figure 19A:
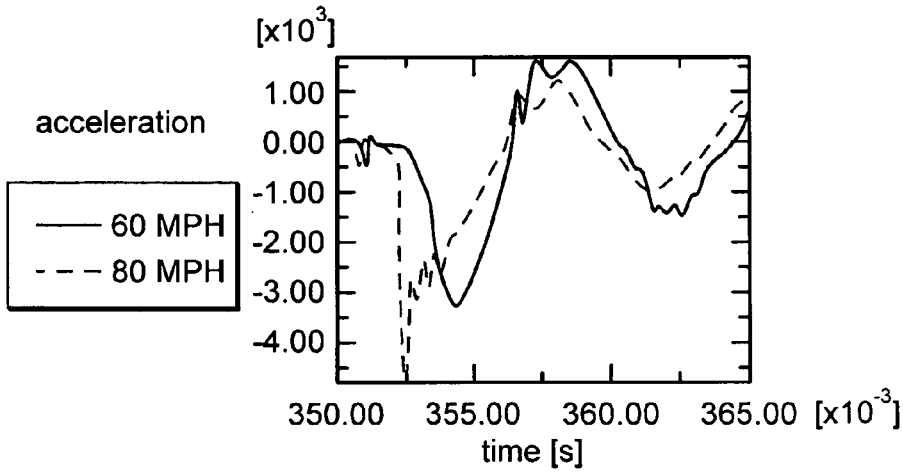
FIGS. 19*a* and 19*b* are graphical representations of the dynamic response behavior of an embodiment of the present invention for different impact speeds.
Figure 19B:
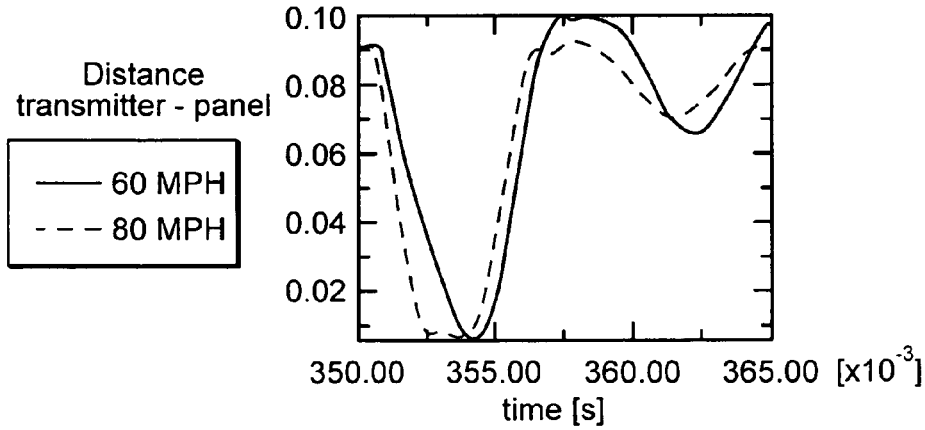

FIGS. 19*a* and 19*b* illustrate the response behavior of a bladder with tetrahedrically arranged pulling elements with two different impact speeds, namely 60 mph and 80 mph. One sees the clearly higher accelerations at the higher speed (dashed curves) and the longer contact with the outer surface (panel).

In this embodiment, it is generally possible to influence the dynamic properties of the bladder 1, such as the response of the bladder to a deformation, by a suitable design of the pulling elements 60. To this end, the number of fibers in a pulling element may be varied as well as their interconnection with each other. The use of fibers other than the aforementioned aramide fibers with a non-linear elongation behavior is possible for influencing selectively the stability of the anchoring of the transmitter.

A plastic material can be injected around the outer and the inner end of the fiber bundle 61 to manufacture a mounting section 62, for example by simply injecting a thickening mass onto the bundle. In this case, the pulling element 60 only needs to be guided through an opening 53 in the chamber 50 of a suitable size for anchoring the pulling element to the spherical chamber 50. It is also conceivable to manufacture the chamber 50 out of two or more (half-)shells that are injected around the mounting section 62 and are clipped to each other or welded together after inserting the device 30. As a result, the manufacture of the bladder 1 is facilitated significantly.

Using once more injected mounting sections 62, mounting feet 63 are arranged at the ends of the pulling elements 60 opposite to the chamber 50. The mounting feet 63 serve to anchor the chamber 50 and the pulling elements 60 to the outer surface 2 circular disc-like shaped of the bladder 1. This may be achieved by gluing, high frequency welding, or other common processing techniques for plastic materials. If the mounting feet 63 are also manufactured from a sufficiently temperature-resistant material, the overall bladder 1 can be pre-assembled before it is brought into the desired shape and size by a final molding step.

FIGS. 13*a*-13*d* show various embodiments of the mounting feet 63 for anchoring the pulling elements 60 on the outer surface 2 of the bladder 1. The mounting feet 63 should include a sufficiently large contact surface 65 for the outer surface 2 of the bladder 1 and provide sufficient support for the respective pulling element 60, guaranteeing tensile strength.

Figure 13A:
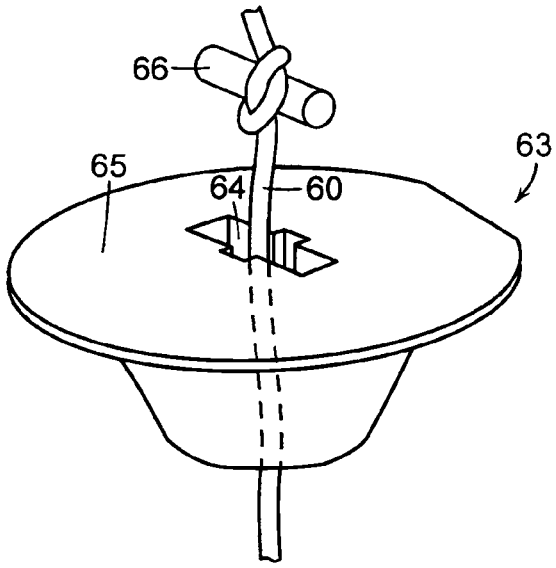
FIGS. 13*a*-13*d* are schematic perspective views of the various embodiments of the mounting means depicted in FIG. 7.

In the embodiment of FIG. 13*a*, the pulling element 60 is guided around a pin 66 in a loop, the pin 66 being arranged in a recess 64 on the contact surface 65 of the mounting foot 63. The pin 66 may be made of a sufficiently stable plastic material or also of a metal to be able to resist higher tensile forces. The two loose ends of the pulling element 60 are, in this embodiment, fixed to the chamber 50.

Figure 13B:
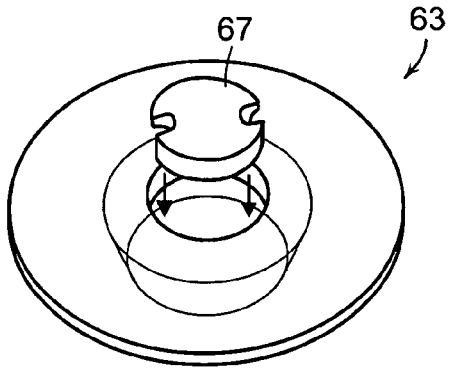

FIG. 13*b* shows a modification using a button-like insert 67 instead of the pin 66, around which the pulling element 60 is guided. This embodiment is more advantageous if the mounting foot 63 is made completely of plastic, since the button-like insert 67 has a larger surface for resisting the high tensile stresses on the pulling elements 60.

Figure 13C:
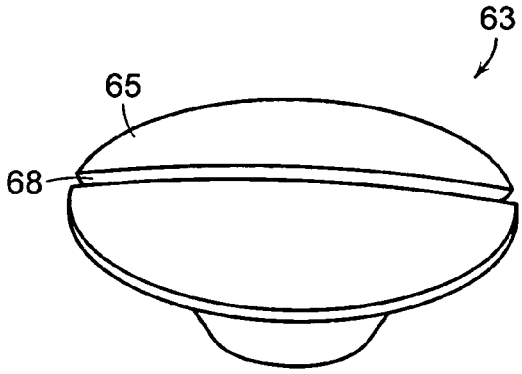

FIG. 13*c* shows a further variant allowing for a simplified production. Here, the loop of the pulling element 60 is guided through a suitable recess 68 in the contact surface 65 without requiring a further component.

Figure 13D:
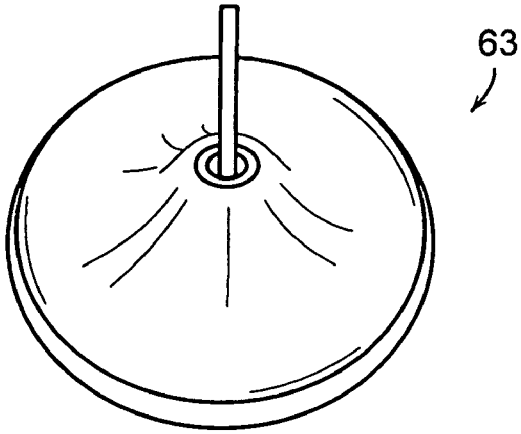

FIG. 13*d* shows an embodiment wherein a plastic material is first injected around the end of the pulling element 60, which is then also received by a recess in the contact surface. The production of this variant can be automated simply. Instead of the injection, it is also perceivable to provide a knot at the outer end of the pulling element 60, which is received by the recess in the contact surface 65.

The described examples for the mounting feet 63 of the pulling element 60 on the bladder 1 can, in a smaller embodiment, also be used for anchoring the chamber 50 at the inner end of the respective pulling element 60. Moreover, the mounting feet 63 can also be used if one or more pulling elements 60 extend through the outer surface 2 of the bladder 1 and are anchored on the carcass 300. Additionally, it may be desirable to reinforce the ends of the fibers 61 used for the pulling element 60.

In one embodiment, the pulling elements 60 are arranged such that they encase by pairs at substantially identical angles. In the case of four pulling elements, as shown in FIG. 7, this leads to a tetrahedral configuration of the pulling elements 60 with an angle of about 109.47 degrees. If six pulling elements are used, an angle of about 90 degrees results. Such an arrangement evenly distributes the tensile acting along the pulling elements 60, thereby resulting in the summation of the forces acting on the chamber 50 equaling about 0. The chamber 50 will be in static equilibrium.

For a further stabilization of the suspension of the transmitter, it is possible to arrange one or more transverse connections between the pulling elements 60. One such embodiment is schematically shown in FIG. 14. Besides the pulling elements 60 extending radially from the center, one can see a plurality of transverse connections 69. A structure similar to a three-dimensional spider web results. The forces occurring during accelerations or deformations of the ball are, therefore, distributed more evenly to the entire bladder, and the ball's response behavior becomes more homogenous.

Figure 15:
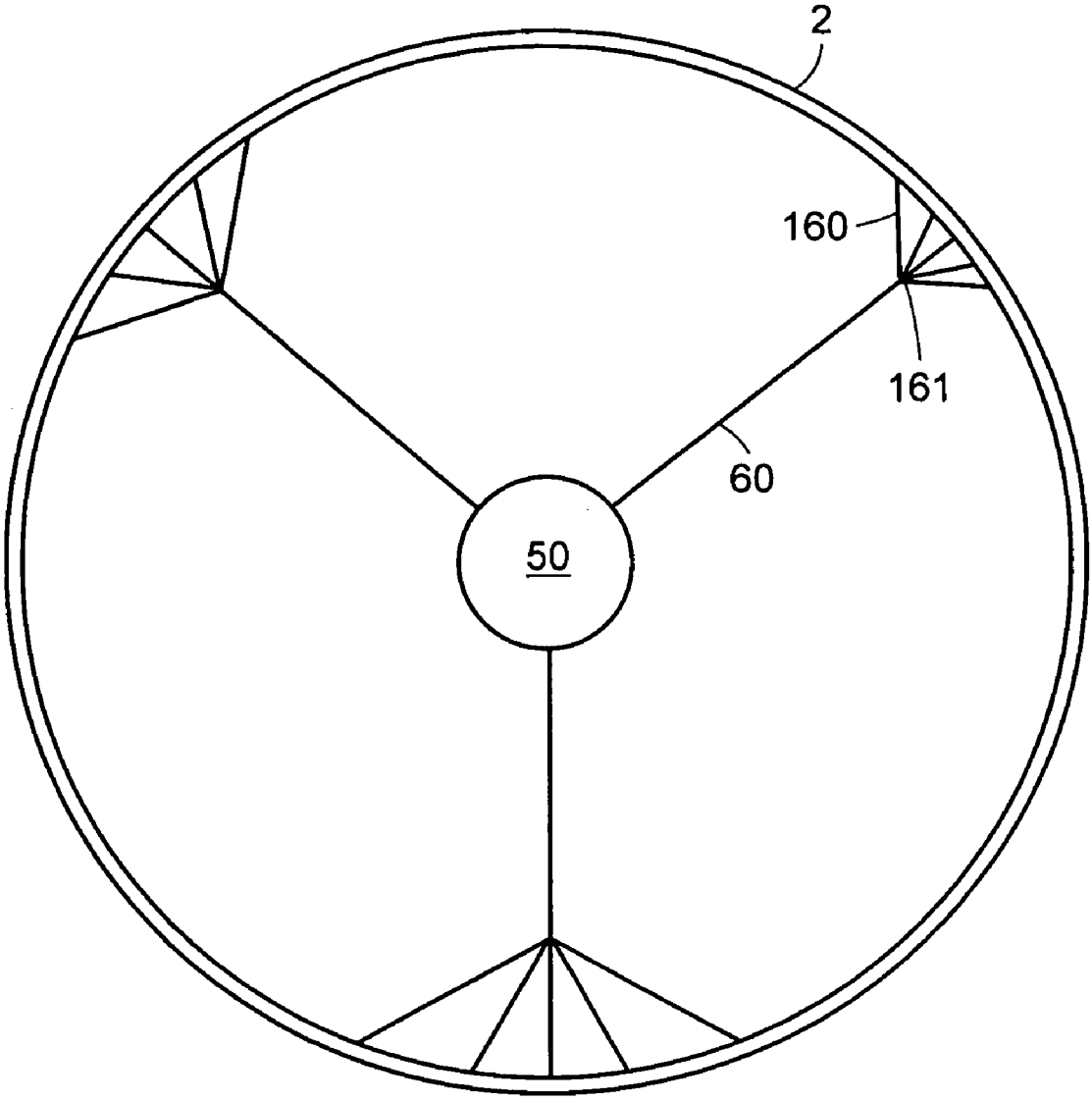
FIG. 15 is a schematic plan view of a bladder in accordance with an alternative embodiment of the invention, with branching pulling elements.

FIG. 15 shows a further embodiment, where at least one pulling element 60 branches off into a plurality of sub-elements 160, extending from a branching point 161 to the outer surface 2 of the bladder 1. Thus, the contact point of the tensile load transmitted via the pulling element 60 is distributed to a larger area of the outer surface 2. In the version shown in FIG. 15, the branching point 161 is close to the outer surface. It is, however, also possible to position the branching point 161 in the center of the pulling element 60 or even close to the chamber 50. An arrangement in which one or more sub-elements 160 are again branched off is also contemplated and within the scope of the present invention. The combination of using the transverse connections 69 from FIG. 14 with the sub-elements 160 from FIG. 15 is also possible. In this case, the transverse connections 69 may interconnect pulling elements 60 among themselves, or also pulling elements 60 and sub-elements 160, or sub-elements 160 among themselves. In this case, an at least substantially symmetrical arrangement is desirable for ensuring even mechanical properties of the ball.

If a fiber bundle 61, e.g., the aforementioned aramide fibers, are used as pulling elements 60, the split-up at the branching point 161 is particularly simple to realize. In this case, the bundle 61 only has to be divided into separate partial bundles, extending to the outer surface 2 from the branching point 161 in different directions.

Figure 8:
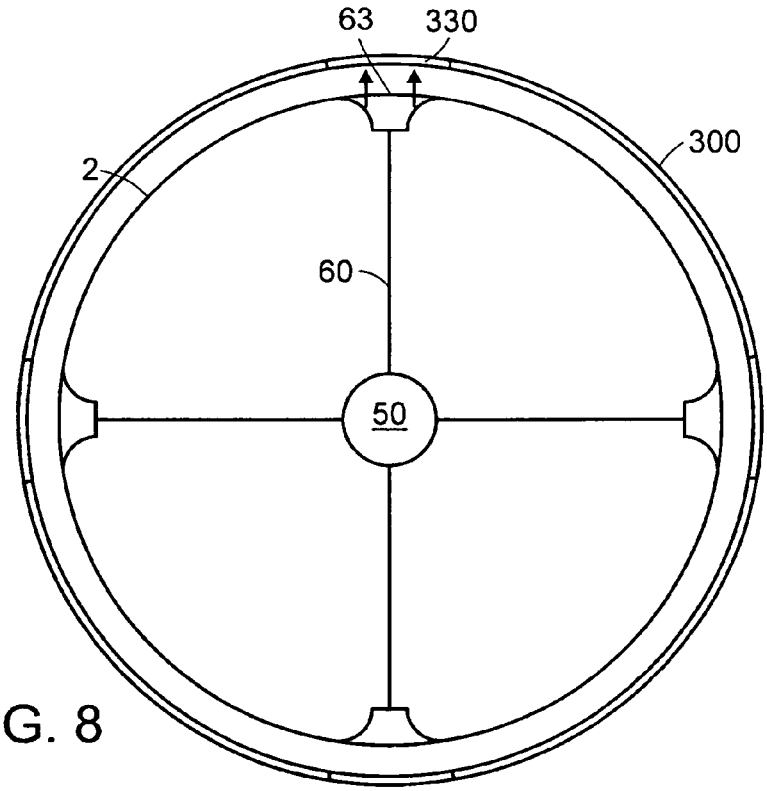
FIG. 8 is a schematic plan view of a bladder in accordance with an alternative embodiment of the invention, wherein a carcass aids in the mounting of the electronic component.

FIG. 8 shows a modified version of the embodiment of FIG. 7. The mounting feet 63 in this embodiment are connected with corresponding mounting surfaces 330 on the inner side of the carcass 300 (see arrows in FIG. 8) by, for example, adhering, high-frequency welding, or similar techniques. Similar to the embodiment of FIG. 5, the carcass 300 is also included in the suspension of the transmitter in FIG. 8 in order to achieve an additional degree of stability.

Figure 9:
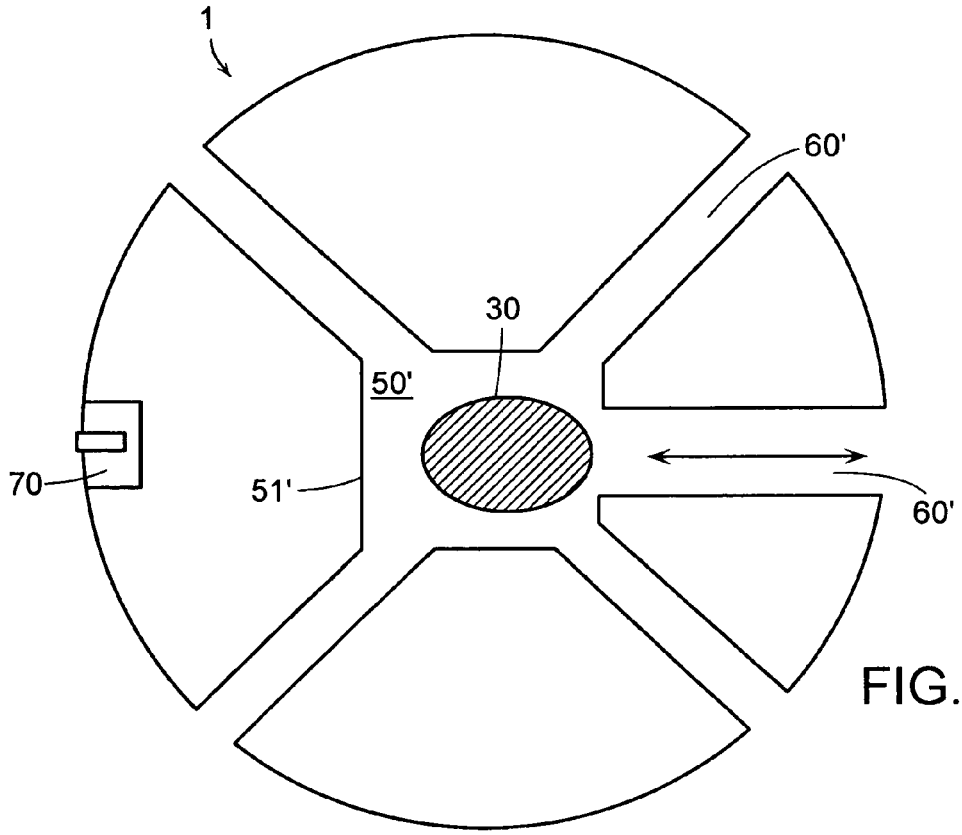
FIG. 9 is a schematic plan view of a bladder in accordance with an alternative embodiment of the invention, including several hollow struts.
Figure 10:
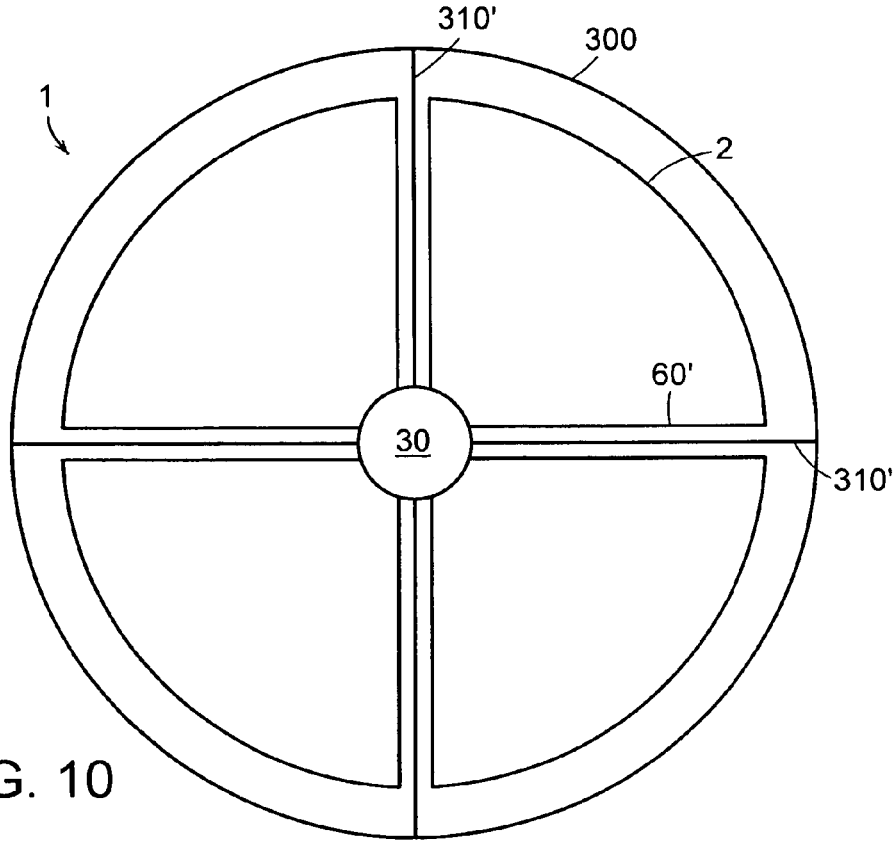
FIG. 10 is a schematic plan view of the bladder of FIG. 9, wherein additional mounting cables anchor the transmitter to the carcass.

FIGS. 9 and 10 depict an alternative embodiment of the present invention. In this embodiment, the bladder 1, struts 60' and the chamber 50' are manufactured from an integral piece of material, for example latex. The latex can, if necessary, be reinforced by additional fibers and/or a pre-treatment, e.g., an expansion. The reinforcing fibers may be added during the production of the latex solution or be introduced later on. It is also possible to arrange the fibers at certain positions on the molding tool for the latex solution so that they are embedded into the latex material during its production. In a further embodiment, a latex material with a varying thickness is used in order to locally influence the elastic properties of the bladder 1.

The bladder 1 includes a plurality of hollow struts 60' extending from the outer surface 2 of the bladder into its interior and defining a chamber 50'. One of the hollow struts 60' may include a greater diameter for inserting and, if necessary, removing the electronic device 30. To compensate for the possible greater weight of this hollow strut 60', the strut 60' can be arranged on the opposite side of the receptacle 70 for the valve of the bladder 1. As a result, an imbalance of the inflated bladder is to a large extent avoided. If the bladder 1 is inflated, the air pressure forces the walls 51' of the chamber 50' against the device 30 and immobilizes it in the center of the bladder 1, without any additional measures. In contrast to some of the embodiments described above, gluing or welding is no longer necessary after inserting the electronic device. The configuration and the diameter of the hollow struts 60' as well as the chamber 50' in FIG. 9 are illustrative only. Other shapes and dimensions are contemplated and within the scope of the present invention, as well as the arrangement of several chambers 50' to receive more than one electronic device, for example the above-mentioned redundant transmitters.

FIG. 10 shows a modification of the embodiment from FIG. 9, wherein the transmitter 30 is fixed to the carcass 300 by means of additional mounting cables 310' extending through the hollow struts 60'. This embodiment can also do without any reinforced latex material, since the cables 310' can take up sufficient tensile forces to maintain the transmitter 30 in a stable manner in the center of the bladder 1. In an advantageous manner, the embodiment of FIG. 10 can, therefore, connect aspects of the embodiments from FIGS. 7 and 8 with the variant of FIG. 9.

Figure 18A:
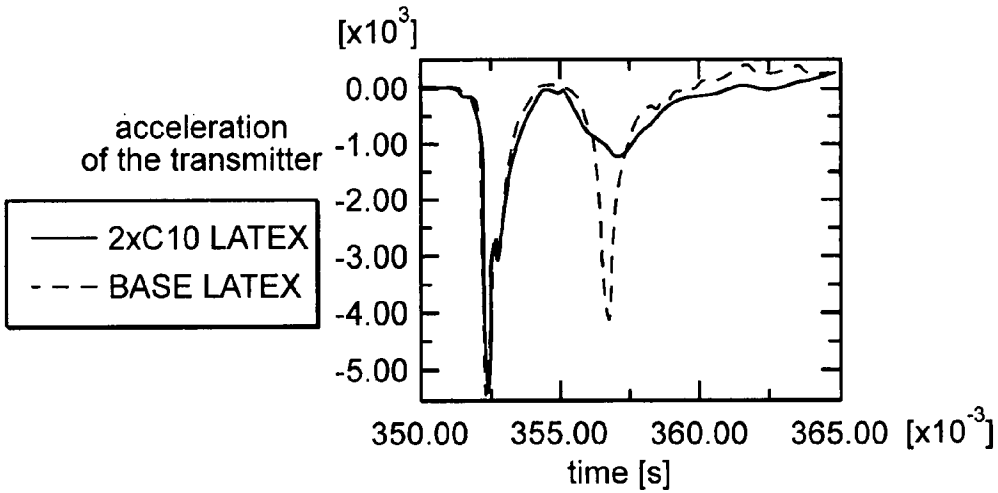
FIGS. 18*a* and 18*b* are graphical representations of the results of a finite element analysis examining the acceleration and deflection of the transmitter when various kinds of latex are used.
Figure 18B:
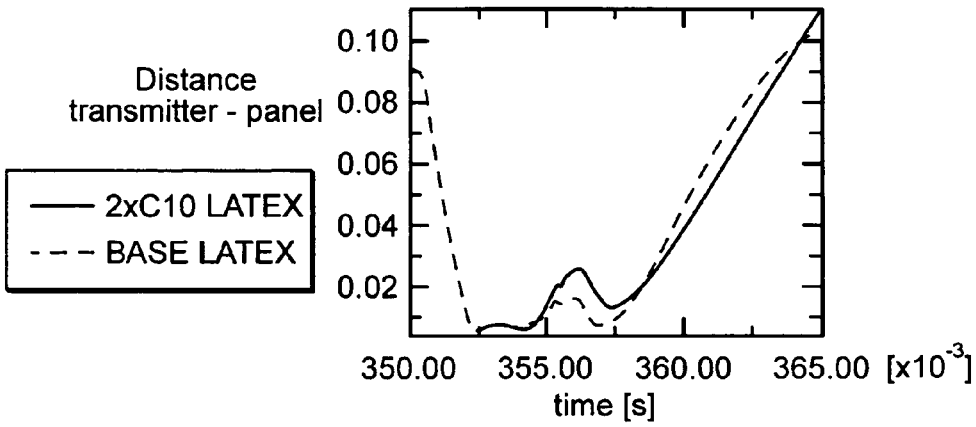

The influence of different latex materials on the acceleration and deflection is shown in FIGS. 18*a* and 18*b*. One can see that, in particular, the oscillation behavior after the first impact clearly differs, depending on the respectively used material. While the dashed curve shows a significant second acceleration of the transmitter after approximately 357 ms, this "after-oscillation" can hardly be observed with the material corresponding to the solid curve. The material designated "2×C10 Latex" has a substantially doubled stiffness compared to the material designated "BASE LATEX".

Figure 11:
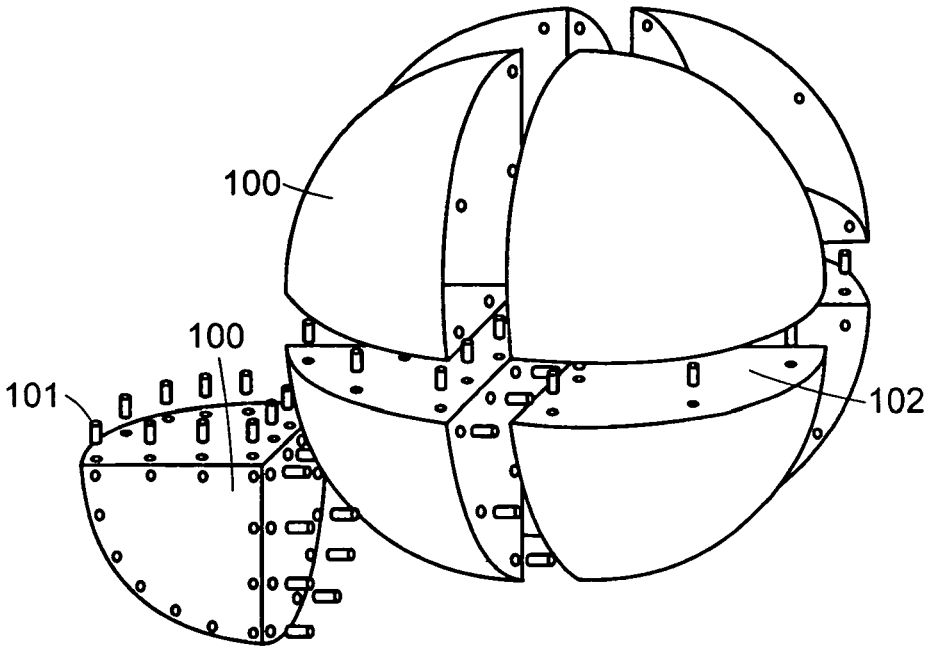
FIG. 11 is a schematic perspective view of forming elements for the manufacture of a bladder with a complex shape in accordance with one embodiment of the invention.
Figure 12:
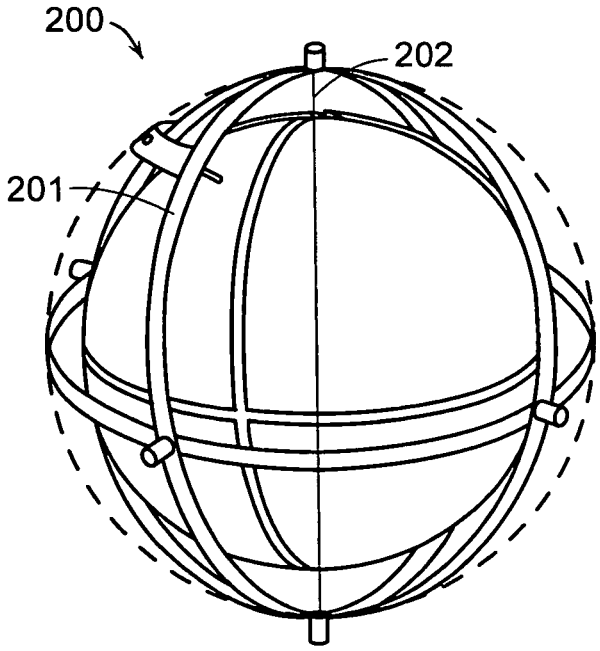
FIG. 12 is a schematic perspective view of a framework for supporting the forming elements of FIG. 11 during production of the bladder.

FIGS. 11 and 12 illustrate a possible apparatus for producing a complex bladder, for example the bladders 1 shown in FIGS. 1-4. To this end, several forming or molding elements 100 are manufactured from a material with a low melting point, for example wax, or from a material dissolving in a suitable liquid, such as water or oil. In the disclosed embodiment, the molding elements 100 are shaped as segments of a sphere, however, other shapes are possible to suit a particular application. Using pin-like connections 101, these segments 100 are assembled such that horizontal and vertical gaps 102 extend through the sphere. From a geometrical viewpoint, the gaps 102 lie in planes defined by a Cartesian coordinate system having its center in the center of the sphere. Other arrangements, in particular for creating the tetrahedral arrangement of the reinforcing elements shown in FIG. 2, are also possible.

If the assembled elements 100 are used for molding, for example injection molding or immersion into a solution of suitable bladder material, for example latex, an integral bladder 1 is created having reinforcing surfaces or walls in its interior. During the final shaping step, the transmitter may either be maintained in its position by the forming elements 100 or it is inserted into the finished bladder later on. Due to the pin-like connections 101 there are tube-like interconnections between the segments of the bladder molded around the forming segments 100. As a result, only a single valve connection is required for inflating the entire bladder 1.

FIG. 12 shows an apparatus for maintaining the forming elements 100 during production of the bladder 1 in the desired position. To this end, an outer framework 200 made from metal or plastic strips 201 or the like is used together with wires 202 extending from several directions through the interior of the assembled mold body. Furthermore, the wires 202 may serve to hold the transmitter in place during the manufacture of the bladder. The wires 202 may be integrated into the bladder 1 during manufacture, such that they can subsequently serve as mounting cables 310 to anchor the transmitter in the above described manner to the carcass.

When the molding process is terminated, the outer framework 200 is removed and the bladder 1, including the forming elements 100, is heated up to the melting temperature of the material used for the molding elements 100. The liquid material is then removed through the opening for the valve (prior to inserting the valve) by moving the bladder 1. In the case of molding parts that are dissolvable in a liquid, the latter are dissolved by being contacted with a suitable solvent. As a result, a complex bladder shape can be produced by the described method, which to a great extent no longer needs manual steps for anchoring the electronic device in the center of the bladder.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. A bladder for an inflatable ball comprising:

at least one electronic device configured to at least one of send and receive an electronic signal and arranged within the bladder; and a plurality of substantially inelastic tension elements coupled to and disposed at least partially within the bladder and coupled to the at least one electronic device to maintain the device in a predetermined position within the bladder during movement of the bladder, wherein the tension elements each comprise a mounting foot at one end thereof to anchor the tension element to an outer surface of the bladder, the mounting foot comprising a generally circular disc like shape and each tension element looped about a recess in a corresponding mounting foot.

2. A bladder according to claim 1, wherein the plurality of substantially inelastic tension elements comprises multiple pairs of tension elements defining substantially identical angles.

3. A bladder according to claim 1, wherein the plurality of substantially inelastic tension elements is arranged tetrahedrically within the bladder.

4. A bladder according to claim 1, wherein each of the substantially inelastic tension elements is subjected to a tensile force between the electronic device and the bladder and arranged such that a summation of the tensile forces on the electronic device equals substantially 0 , thereby maintaining the electronic device in static equilibrium in any orientation of the bladder.

5. A bladder according to claim 1, wherein the tension elements provide a restoring force to the electronic device subsequent to a foot strike to maintain the device in the predetermined position.

6. A bladder according to claim 1, wherein each of the plurality of substantially inelastic tension elements exhibit non-linear elongation.

7. A bladder according to claim 1, further comprising a plurality of transverse elements interconnecting at least two of the tension elements.

8. A bladder according to claim 1, wherein at least one of the substantially inelastic tension elements is coupled to the bladder via a plurality of sub-elements branching off from the at least one substantially inelastic tension element.

9. A bladder according to claim 1, wherein the device is arranged inside a separate chamber within the bladder.

10. A bladder according to claim 9, wherein the chamber is defined by a plurality of auxiliary surfaces extending between the tension elements.

11. A bladder according to claim 9, wherein the chamber comprises a substantially spherical shape.

12. A bladder according to claim 9, wherein the chamber is airtight with respect to an interior of the bladder.

13. A bladder according to claim 9, wherein the chamber is in fluid communication with an interior of the bladder to allow an equalization of pressure inside and outside the chamber.

14. A bladder according to claim 1, wherein the device is arranged substantially in a center of the bladder and at least one of the substantially inelastic tension elements extends substantially radially outwardly from the device.

15. A bladder according to claim 1, wherein each of the substantially inelastic tension elements comprises a bundle of fibers and the mounting section comprises a plastic material injected around the bundle of fibers.

16. A bladder according to claim 15, wherein the bundle of fibers has an impulse tensile strength of greater than 500 N.

17. A bladder according to claim 15, wherein the bundle of fibers has an impulse tensile strength of greater than 1200 N.

18. A bladder according to claim 1, wherein the substantially inelastic tension elements are sufficiently heat resistant to withstand temperatures arising during bladder molding.

19. A ball comprising:

a bladder in accordance with claim 18; and a carcass arranged between the bladder and an outer shell of the ball, wherein the substantially inelastic tension elements are mounted to the bladder via the mounting foot and the bladder is mounted to a mounting surface of the carcass.

20. A bladder according to claim 1, wherein the at least one electronic device is selected from the group consisting a pressure sensor, a global positioning system, and an accelerometer.

21. A bladder according to claim 1 further comprising an electrical connection in communication with the at least one electronic device and configured to exchange electronic signals.

22. A bladder according to claim 1 further comprising a charging device in communication with the at least one electronic device and configured to charge the at least one electronic device.

23. The bladder according to claim 1, wherein each tension element is looped along an elongate recess spanning at least a portion of a diameter of the corresponding mounting foot.

* * * * *